US005120010A

United States Patent [19]

Magee

[11] Patent Number: 5,120,010

[45] Date of Patent: Jun. 9, 1992

[54] BIPLANAR STRUCTURAL ADDITIVE FOR PLANES OF WORK

[75] Inventor: James G. Magee, 494 Hendersonville Rd., Asheville, N.C. 28803

[73] Assignee: James Glenn Magee, Asheville, N.C.

[21] Appl. No.: 682,325

[22] Filed: Apr. 9, 1991

[51] Int. Cl.[5] ..... B65G 5/00

[52] U.S. Cl. ..... 248/118; 248/918

[58] Field of Search ..... 248/118, 118.1, 118.3, 248/118.5, 916, 917, 918, 678; 400/715

[56] References Cited

U.S. PATENT DOCUMENTS 4,482,063 11/1984 Berke et al. ..... 248/118 X
4,545,554 10/1985 Latino et al. ..... 248/118.3 X
4,913,390 4/1990 Berke ..... 248/118.3 X
4,976,407 12/1990 Schwartz ..... 248/118.3

FOREIGN PATENT DOCUMENTS 0025045 of 1895 United Kingdom ..... 248/118.3

*Primary Examiner*—Ramon O. Ramirez

[57] ABSTRACT

This is a biplaner structure that was fashioned to give arm support during keyboard operation, product assembly and craftwork. It consists of a base (2) connected at a joint to an arm rest (1). The base (2) is of sufficient area to provide for individual differences in size and work placement preference of operators. The arm rest provides support above the work plane to the arms of the operator and below the work plane to act as an anchor to secure the unit. The unit has one moving part, a roller (5) which rotates freely on an axis, on one end of arm rest (1). This roller (5) provides the same support as the arm rest (1) while operating external computer accessories.

4 Claims, 1 Drawing Sheet

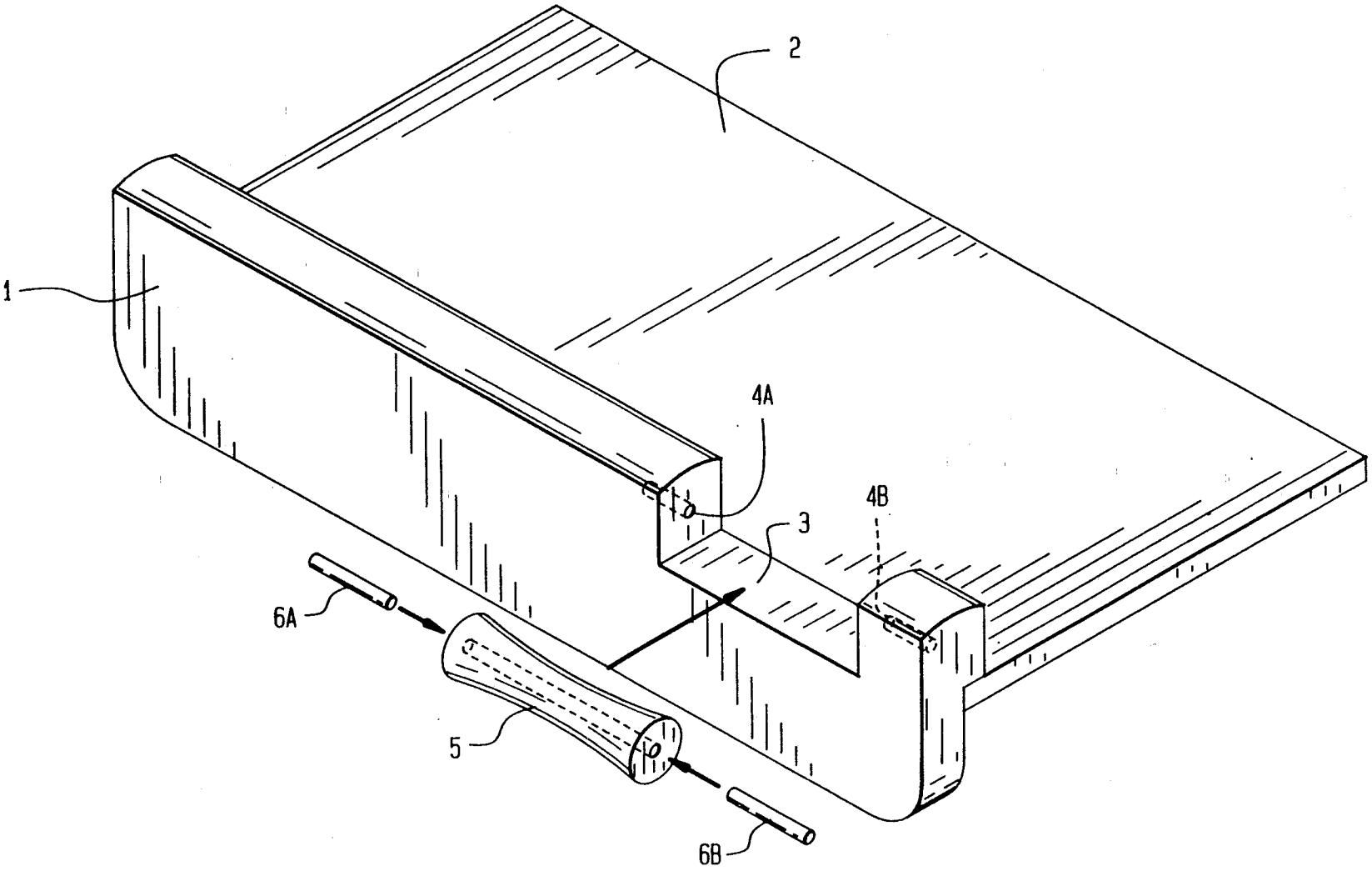
2
4A
3
4B
6B
5
6A
1

BIPLANAR STRUCTURAL ADDITIVE FOR PLANES OF WORK

BACKGROUND-FIELD OF INVENTION

This invention relates to arm rests, specifically to arm rests that prevent excessive upper body motion for operators using computer keyboards and external computer accessories, typists, product assemblers and certain crafters.

BACKGROUND-DESCRIPTION OF PRIOR ART

The identification of Repeated Motion Syndrome has made it expedient for companies to put wrist rests on the market in an effort to alleviate the Syndrome. Of the rests on the market, Forminco's "great big difference" TM and BD-2, Patents Pending, are adjustable to a certain degree. It allows the change of angle for the operator's hands to approach the keyboard but it does not allow for depth adjustment to the keyboard in order to accommodate for the variation of operator hand comfort. This rest does not allow for support of any externally operated devices on the computer. The height is insufficient to provide maximum support for the relaxation of the arms that is needed to relieve Repetitive Motion Syndrome.

Other units on the market merely change the angle of the computer keyboard and provide no support for arms or wrists of the operator.

The units presently on the market are not anchored to the work surface in any way other than their own weight and the weight of the keyboard. This allows for slippage of the entire unit.

The units on the market at this time are made of non-renewable natural resources.

OBJECTS AND ADVANTAGES

Besides the objects and advantages of the arm rest described above, several objects and advantages of the present invention are:

(a) to provide a ninety degree bend of the elbow that allows the muscles of the operator to relax from the neck to the wrist;

(b) to provide a support surface which will not irritate the skin of the operator;

(c) to provide the same support during the reciprocating motion required to operate an external computer accessory;

(d) to provide a non-slip rest that is also anchored to the front edge of the work plane;

(e) to provide an equal support for left handed operators;

(f) to provide a support constructed from a renewable natural resource;

Further objects and advantages are to provide a wrist support that will function on any desk or work plane without altering said surface. Still further objects and advantages will become apparent from a consideration of the ensuing description and drawings.

DRAWING FIGURE

In the drawing, closely related element have the same number but different alphabetic suffixes.

The single drawing FIGURE illustrates the arm rest of my invention in partially-exploded form.

Reference Numerals In Drawings

| | | | |
|---|---|---|---|
| 1 | Arm Rest | 5 | Roller |
| 2 | Base | 6A and 6B | Dowels |
| 3 | Cutout | | |
| 4A and 4B | Holes in Cutout | | |

DESCRIPTION

A typical embodiment of the biplanar structure is illustrated in the FIGURE showing the arm rest 1 attached to the front of the base 2. Roller 5 is attached within the confines of the cutout 3 using dowels 6A and 6B. Exact placement and proportion of the dowels 6A and 6B to the roller 5 and cutout 3 is essential for proper operation.

The base 2 is of a large enough size to accommodate a computer keyboard, small parts or craft items with room for adjustment of distance to work item. This adjustment allows for the different sizes of operators' hands and arms and promotes proper posture which also helps alleviate Repetitive Motion Syndrome.

The edge of base 2 is fastened in a joint to arm rest 1. The arm rest 1 extends above the working surface at a proper height to accommodate most computer keyboards in order to allow the weight and tension of the operator's arms, from the neck to the wrist to be relaxed and positioned in a ninety degree angle, during the typing process. The roller 5 is secured in position at the same height to facilitate external computer component use.

The arm rest 1 is of sufficient width at its top edge to allow the operator's arms or wrists to rest upon it without discomfort. Arm rest 1 falls below base 2 at a sufficient distance to secure the structure to any planar work surface without altering the surface in any manner.

The roller 5 is constructed in such a fashion that it can be put on either end of the arm rest 1 to accommodate both right and left handed operators.

OPERATION

Base 2 rests parallel on the working plane and arm rest 1 is placed flush to the front edge of the working plane. The computer keyboard is set on the base 2. Any external computer accessory is placed behind roller 5 on base 2. The operator places his/her wrists on the top surface of rest 1 and positions keyboard to the most comfortable position. The operator must then relax his/her shoulders and let the unit support the weight of the arms. This will result in decreased movement of upper body, a limited degree of flex in the wrist and improved typing posture.

SUMMARY, RAMIFICATIONS AND SCOPE

One can see that the biplanar structural additive for planes of work can alleviate or help avoid Repetitive Motion Syndrome, an increasingly debilitating syndrome affecting many secretaries and machine operators today.

The biplanar structural additive for planes of work can accomplish the above in that the base is of sufficient size that all operators will have room to position their work to suit their own physical size;

the arm rest is at a proper height to provide a ninety degree bend of the elbow, allowing the muscles of the operator to relax from neck to wrist;

the support surface will not irritate the skin of the operator;

the roller provides the same support as the arm rest during the reciprocating motion required to operate an external computer accessory;

the base is secured to the front edge of the work plane providing a non-slip rest and work area;

the arm rest and roller configuration can be reversed to accommodate left handed operators.

Although the description above contains many specificities, these should not be construed as limiting the scope of the invention but as merely providing illustrations of some of the presently preferred embodiments of this invention. For example, the roller arrangement can be reversed to accommodate left-handed operators.

Thus the scope of the invention should be determined by the appended claims and their legal equivalents, rather than by the examples given.

I claim:

1. An arm rest for use with a keyboard and an external computer accessory, said arm rest comprising:

a base portion having an upper and a lower surface;

an arm rest portion attached perpendicular to said base portion, said arm rest portion having an upper surface extending above the upper surface of said base portion;

a cut-out portion in the upper surface of said arm rest portion; and a roller received in said cut-out portion.

2. An arm rest as recited in claim 1, wherein said roller has two ends and a dowel secured to each of said ends.

3. An arm rest as recited in claim 2, wherein the cutout has holes for receiving the dowels.

4. An arm rest as recited in claim 1, wherein said arm rest portion has a lower surface extending below the lower surface of said base portion.

* * * * *